US006128449A

United States Patent [19]

Zenba et al.

[11] Patent Number: 6,128,449

[45] Date of Patent: Oct. 3, 2000

[54] IMAGE FORMING APPARATUS AND METHOD FOR CONTROLLING CHARGING AND DEVELOPING BIAS VOLTAGE

[75] Inventors: Hideki Zenba; Masaru Tanaka, both of Kanagawa-ken; Haruji Mizuishi, Tokyo; Hiroyuki Okaji; Kenzo Tatsumi, both of Kanagawa-ken; Hiroshi Mizusawa; Ken Amemiya, both of Tokyo; Mayumi Ohori, Kanagawa-ken, all of Japan

[73] Assignee: Ricoh Company, Ltd., Tokyo, Japan

[21] Appl. No.: 09/166,146

[22] Filed: Oct. 5, 1998

[30] Foreign Application Priority Data

Oct. 3, 1997 [JP] Japan ..... 9-270769
Aug. 28, 1998 [JP] Japan ..... 10-243867

[51] Int. Cl.[7] ..... G03G 15/02

[52] U.S. Cl. ..... 399/50; 399/55

[58] Field of Search ..... 399/50, 55, 38, 399/46, 56, 48

[56] References Cited

U.S. PATENT DOCUMENTS

| | | | |
|---|---|---|---|
| 4,974,026 | 11/1990 | Maruyama | 399/46 |
| 5,444,519 | 8/1995 | Motoyama et al. | 399/50 |
| 5,678,130 | 10/1997 | Enomoto et al. | 399/55 |
| 5,970,279 | 10/1999 | Sakaizawa et al. | 399/46 |

FOREIGN PATENT DOCUMENTS

| | | |
|---|---|---|
| 60-256160 | 12/1985 | Japan . |
| 4-106568 | 4/1992 | Japan . |
| 6-67518 | 3/1994 | Japan . |
| 6-258873 | 9/1994 | Japan . |

*Primary Examiner*—Robert Beatty
*Attorney, Agent, or Firm*—Oblon, Spivak, McClelland, Maier & Neustadt, P.C.

[57] ABSTRACT

An image forming apparatus includes a charging element configured to apply a charging voltage to an image bearing member to charge the image bearing member, an optical writing device configured to form a latent image on a charged surface of the image bearing member charged by the charging element, a developer bearing member which carries developer including toner having a same polarity as that of the charging voltage to the image bearing member and which applies the toner to the latent image on the image bearing member to form a toner image when a developing bias voltage is applied thereto, and a control device which controls application of the charging voltage by the charging element and application of the developing bias voltage to the developer bearing member so as to increase an absolute value of the charging voltage to the image bearing member and an absolute value of the developing bias voltage to the developer bearing member to a predetermined value in a plurality of steps, respectively and wherein the following relation holds for each of the plurality of steps:

$$190(V) \leqq (V_{DC} - V_D) \leqq 375(V)$$

where $V_{DC}$ represents a mean value per unit time of the developing bias and $V_D$ represents a charged potential of the image bearing member.

12 Claims, 5 Drawing Sheets

Fig. 3

| VDC (V) | | 50 | 0 | -50 | -100 | -150 | -200 | -300 | -400 | -500 | -600 | -700 |
|---|---|---|---|---|---|---|---|---|---|---|---|---|
| offset (V) | | -475 | -525 | -575 | -625 | -675 | -725 | -825 | -925 | -1025 | -1125 | -1225 |
| high (V) | | 400 | 350 | 300 | 250 | 200 | 150 | 50 | -50 | -150 | -250 | -350 |
| low (V) | | -1350 | -1400 | -1450 | -1500 | -1550 | -1600 | -1700 | -1800 | -1900 | -2000 | -2100 |
| CHARGED POTENTIAL OF OPC DRUM 1 VD (V) | -390 | ▼ | O | O | O | O | O | × | × | × | × | × |
| | -475 | ▼ | ▼ | ▼ | O | O | O | O | × | × | × | × |
| | -880 | ▼ | ▼ | ▼ | ▼ | ▼ | ▼ | ▼ | ▼ | O | O | O |

×: "Adhesion of toner" occurs

▼: "Adhesion of carrier" occurs

O: "Adhesion of toner" and "Adhesion of carrier" do not occur

Fig. 4

| CHARGED POTENTIAL OF OPC DRUM 1 VD (V) | MEAN VALUE PER TIME OF DEVELOPING BIAS VOLTAGE VDC (V) |
|---|---|
| −390 | −100 ± 100 |
| −475 | −200 ± 100 |
| −880 | −600 ± 100 |

IMAGE FORMING APPARATUS AND METHOD FOR CONTROLLING CHARGING AND DEVELOPING BIAS VOLTAGE

BACKGROUND OF THE INVENTION

1. Field of the Invention

This invention relates to an image forming apparatus such as a copying machine, a facsimile machine, or a printer, and more particularly to an image forming apparatus and method for controlling a charging voltage and a developing bias voltage.

2. Discussion of the Background

A method of forming a toner image having a sharp edge by applying an AC bias voltage as a developing bias voltage when developing a latent image with toner is well known in an image forming apparatus, as disclosed, for example, in Japanese Laid-Open Patent Publication No. 6-258873.

Also, an image forming apparatus is known, in which a so-called negative-to-positive developing method is used and an AC bias voltage is applied to a developer bearing member carrying toner when developing a latent image with the toner. In such an apparatus, when an image forming operation is started in accordance with a starting instruction from a start switch, a voltage is applied to a charging device from a power source such as a power pack, and the charging device uniformly charges the surface of an image bearing member such as an optical photoconductive drum (hereinafter called an OPC drum). A latent image is formed on a charged surface of the image bearing member with an optical writing device. The toner, which is carried by the developer bearing member and which has the same polarity as that of the charging voltage, is then applied from the developer bearing member to the latent image on the image bearing member, so as to form a toner image, by applying an AC bias voltage as a developing bias voltage to the developer bearing member from the power source. The toner image is then transferred to a transfer medium such as a sheet of transfer paper or an intermediate transfer medium by a transfer device.

In the method disclosed in JP No. 6-258873, a developer bearing member is disposed opposite an image bearing member, and an oscillating bias voltage is applied to the developer bearing member. The oscillating bias voltage includes a first peak voltage for energizing developer which is carried by the developer bearing member to transfer developer to a latent image portion to be visualized, and a second peak voltage for energizing developer moved to the latent image portion back to the developer bearing member. The voltage level of the first peak voltage is between the potential of the latent image portion and the potential of a background portion of the latent image. An absolute value of the first peak voltage (V1) is more than an absolute value of the potential of the latent image portion (VL), and an absolute value of the second peak voltage (V2) is less than that of the potential of the latent image portion (VL) (i.e. V1>VL>V2).

In the above-described image forming apparatus using the negative-to-positive developing method, in which development is performed with toner having the same polarity as that of the charging voltage for the image bearing member, toner is transferred to the image bearing member from the developer bearing member when an absolute value of the surface potential of the image bearing member is smaller than that of the potential of the developer bearing member and thereby a toner image is formed on the image bearing member. When an absolute value of the surface potential of the non-image portion of the image bearing member, such as a charged area preceding a latent image portion of the image bearing member, is smaller than that of the potential of the developer bearing member, toner is also transferred to such a non-image portion of the image bearing member.

Therefore, in order to avoid unnecessary adhering of toner to a charged area preceding a latent image portion of the image bearing member, when a first image forming operation is performed (for example, when a first copy is made by a copying machine), a developing bias voltage is applied to the developer bearing member after a tip portion of the charged area of the image bearing member charged with the charging device reaches a developing area where the developer bearing member and the image bearing member oppose each other, such that the absolute value of the potential of the developer bearing member becomes smaller than the absolute value of the surface potential of the charged area preceding the latent image portion of the image bearing member.

Further, when an absolute value of the surface potential of the image bearing member is excessively greater than that of the potential of the developer bearing member, a problem of adhering of carrier to the image bearing member arises in a two-component developing device using a mixture of toner and carrier, and a problem that toner having an opposite polarity to that of the image bearing member adheres to the image bearing member arises in a one-component developing device using only toner. The carrier adhered to the image bearing member causes, for example, breaking of a cleaning blade and thereby damage to the image bearing member or disturbing a toner image to be formed in the subsequent image forming operation. The toner adhered to the image bearing member causes, for example, to disturb a subsequent toner image to be formed thereupon.

More specifically, for example, when the potential of a surface of an image bearing member is −880V and the developing bias voltage is not applied (the developing bias voltage is 0V), the surface potential of the image bearing member has a potential difference of 880V relative to the potential of the developing bias. This produces a strong electric field in which a positively charged carrier or toner particle is easily transferred to the image bearing member. Therefore, even when a developing bias voltage is applied, if the applied developing bias potential does not rise fast enough and the surface potential of the image bearing member is excessively greater than that of the potential of the developing bearing member, the problem of adhering of carrier and/or toner to the image bearing member occurs, such as, for example, to a charged area preceding a latent image portion of the image bearing member.

Therefore, in order to avoid such unnecessary adhering of carrier and toner having an opposite polarity to that of the image bearing member to the image bearing member, when a first image forming operation is performed, a developing bias voltage is required to be applied to the developer bearing member before a portion of the image bearing member which is fully charged to a predetermined level reaches a developing area where the developer bearing member and the image bearing member oppose each other.

In the image forming apparatus using the negative-to-positive developing method, therefore, a developing bias voltage is generally applied at the same time when the tip portion of a charged area of the image bearing member reaches the developing area where the developer bearing member and the image bearing member oppose each other.

However, depending on a response speed of each power pack for the charging device and the developer bearing member, a developing bias voltage $V_B$ may rise faster than a charging voltage for the image bearing member as illustrated for example in FIG. 8. This may result in the developing bias voltage $V_B$ exceeding the charged potential $V_D$ at a tip portion of a charged area of the image bearing member, which is not charged to a fully charged level 10 when charged by the charging device and which precedes a latent image portion of the image bearing member, and thereby toner adheres to the tip portion of the charged area of the image bearing member preceding the latent image portion, depending on a potential difference between the developing bias voltage $V_B$ and the charged potential $V_D$ of the image bearing member. The toner adhered on the image bearing member is transferred to a contact transfer device in contact with the image bearing member, and stains the contact transfer device. The stained contact transfer device subsequently stains the surface of the image bearing member, which results in disturbing subsequent toner images to be formed.

If the response speed of the power pack for the charging device is sufficiently fast as the power pack for the developer bearing member and the image bearing member is charged such that the absolute value of the charged potential $V_D$ of the image bearing member is greater than the absolute value of the developing bias voltage $V_B$ in the development, the problem of adhering of toner to the image bearing member does not arise. However, a power pack having a fast response speed is large and expensive.

SUMMARY OF THE INVENTION

Accordingly, an object of the present invention is to provide an image forming apparatus and method which can avoid adhering of toner and/or carrier at a tip portion of a charged area of an image bearing member, which precedes a latent image portion of the image bearing member, even when a compact and low-cost power pack is used for a charging device for charging an image bearing member.

To that end, an image forming apparatus according to a preferred embodiment of the present invention includes a charging roller for applying a charging voltage to an image bearing member to charge the image bearing member, an optical writing device for forming a latent image on a charged surface of the image bearing member charged by the charging roller, a developer bearing member which carries developer including toner having a same polarity as that of the charging voltage to the image bearing member and which applies the toner to the latent image on the image bearing member to form a toner image when a developing bias voltage is applied thereto, and a control device configured to increase an absolute value of the charging voltage to the image bearing member and an absolute value of the developing bias voltage to the developer bearing member to a predetermined value in a plurality of steps, respectively.

As another aspect of the present invention, in the image forming apparatus mentioned above, the following relation holds in each of the plurality of steps:

$$190(\mathrm{V}) \leqq (V_{DC} - V_D) \leqq 375(\mathrm{V}),$$

where $V_{DC}$ represents a mean value per time of developing bias voltage applied to the developer bearing member and $V_D$ represents a charged potential of the image bearing member.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 3 is a chart showing a result of an experiment carried out in an image forming apparatus to determine occurrence of adhesion of toner and/or carrier;

FIG. 4 is a chart showing a relationship between a charged potential $V_D$ of an OPC drum 1 and a mean value per time of a developing bias voltage $V_{DC}$ obtained from a result of an experiment;

DESCRIPTION OF THE PREFERRED EMBODIMENTS

Figure 1:
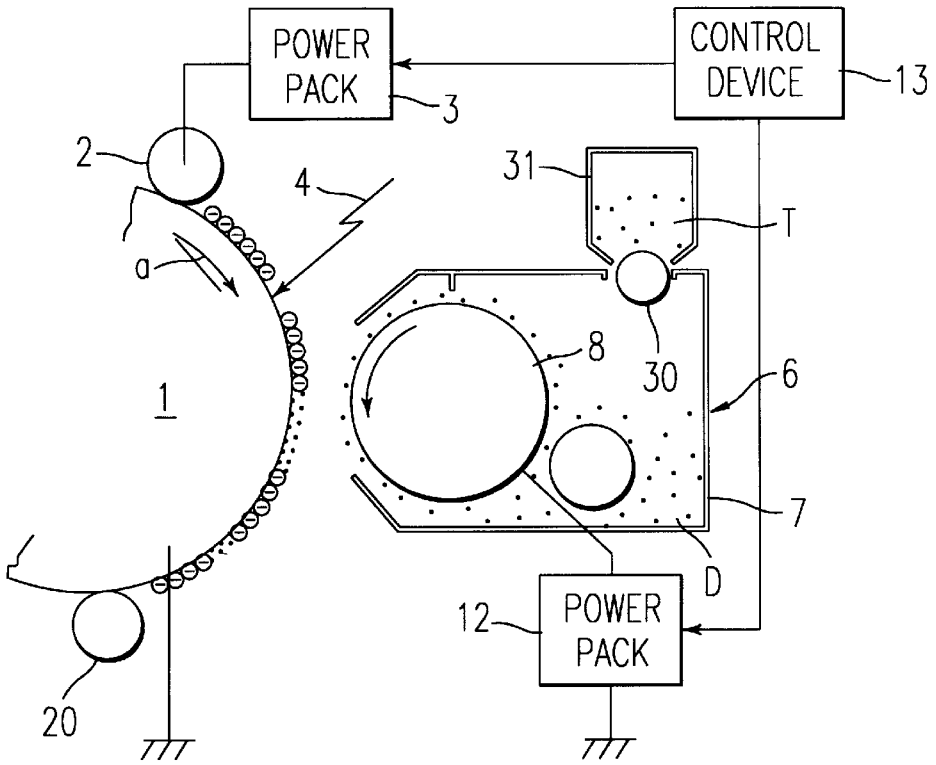
FIG. 1 is a sectional view of a part of an exemplary first embodiment of the present invention.

Referring now to the drawings, wherein like reference numerals designate identical or corresponding parts throughout the several views, and more particularly referring to FIG. 1 thereof, there is illustrated a part of an exemplary image forming apparatus according to a preferred embodiment of the present invention.

In the image forming apparatus of this embodiment, an image forming operation is started in accordance with a starting instruction from an instruction device like a switch. An image bearing member including a photoconductive element, for example, an OPC drum 1, is driven rotationally by a drive section (not shown) in the direction indicated by an arrow a. A voltage is applied to a charging roller 2 as a charging device from a power pack 3 as a power source in an image forming operation, and the charging roller 2 applies a charging voltage to the OPC drum 1 to charge the OPC drum 1 to a uniform charging potential, for example, −880V.

After the OPC drum 1 is charged by the charging roller 2, an image writing device including an exposure device exposes the OPC drum 1 by an exposure light 4 modulated according to image signals, and thereby a latent image 5 is formed on the OPC drum 1. The latent image 5 is developed by a developing device 6 to become a toner image by being supplied with toner having the same polarity as that of the charging voltage. The toner image on the OPC drum 1 is transferred to a transfer medium like a transfer paper sheet or an intermediate transfer medium by a transfer roller 20 as a transfer device.

The developing device 6 includes a developer container 7 which contains two-component powder developer D composed of toner and carrier and a developing sleeve 8 which is disposed in the developer container 7 so as to be rotatably supported by the developer container 7. The developing sleeve 8 is rotated in a counterclockwise direction in a developing operation. The toner and carrier are charged to the polarity opposite to each other by friction between the toner and the carrier. The toner is charged to a negative polarity and the carrier is charged to a positive polarity in this embodiment. A magnet (not shown) is disposed in the developing sleeve 8 and rotation of the developing sleeve 8 causes the two-component developer D to be carried on the circumferential surface of the developing sleeve 8 by a magnetic force and to be moved in the rotational direction to a developing area between the developing sleeve 8 and the OPC drum 1, where the latent image 5 on the OPC drum 1 is developed with the two-component developer D carried on the developing sleeve 8 to become a toner image. Additionally, in order to keep constant a density ratio between toner and carrier of the two-component developer D, toner T contained in a toner hopper 31 is supplied to the developer container 7 by a toner supply roller 30 as the toner is consumed.

Figure 2:
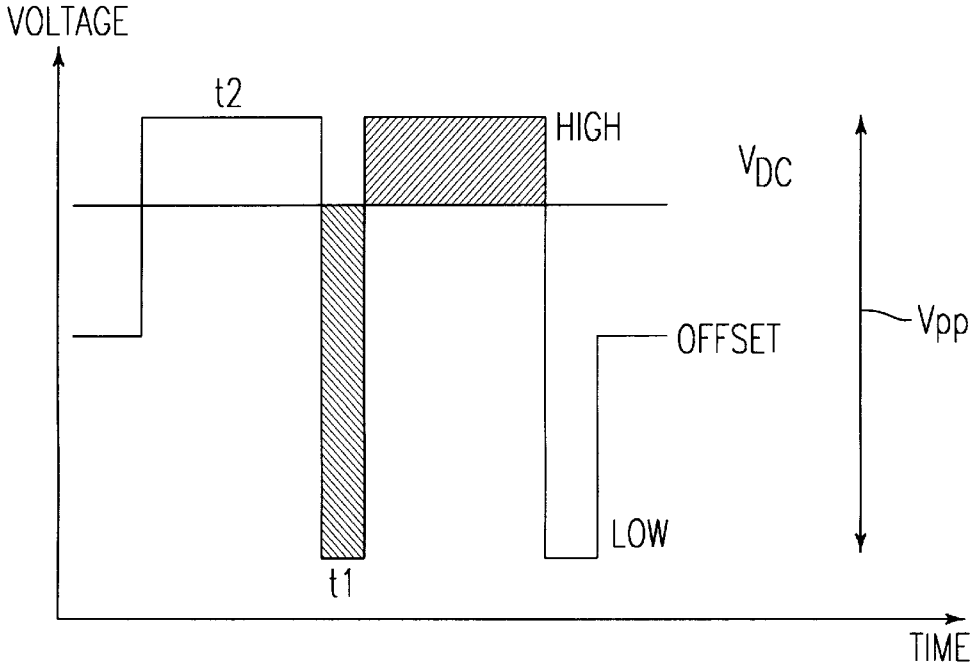
FIG. 2 is a waveform chart showing a waveform of a developing bias voltage in the first embodiment of FIG. 1.

An oscillating voltage as illustrated in FIG. 2 is applied to the developing sleeve 8 as a developing bias from a power pack 12 serving as a power source in an image forming operation. The oscillating voltage has two potentials, each having a rectangular waveform in a fixed condition, for example, that the peak to peak voltage Vpp is 175 kV, the duty ratio is 20% of one cycle of the oscillating voltage, and the frequency is 5KHz. In one cycle of the oscillating voltage, assuming that t1 represents a time in which the voltage for causing a negatively charged toner to move from the developing sleeve 8 to the OPC drum 1 is applied, and t2 represents a time in which the voltage for causing a negatively charged toner to move from the OPC drum 1 to the developing sleeve 8, the duty ratio is given by the following formula:

$$\text{duty ratio}=t1/(t1+t2)\times 100(\%)$$

Referring to FIG. 2, a voltage level indicated as "offset" represents a DC (direct current) voltage value superimposed on an oscillating voltage when the oscillating voltage is applied to the developing sleeve 8 from the power pack 12. The developing bias voltage applied to the developing sleeve 8 from the power pack 12 is equal to the voltage in which the oscillating voltage and the DC voltage are superimposed. Voltage levels indicated as "high" and "low" represent highest and lowest peak voltages of the oscillating voltage, respectively.

In the aforementioned image forming apparatus, it was observed in an experiment that, when a first image forming operation is performed, if the above-described oscillating voltage, superimposed with the offset voltage of −1125V such that a mean value per time of the developing bias voltage $V_{DC}$ becomes −600V, is applied to the developing sleeve 8 at the same time when a tip portion of the charged area of the OPC drum 1 charged with the charging roller 2 reaches the developing area where the developing sleeve 8 and the OPC drum 1 oppose each other, toner is adhered to the tip portion of the charged area of the OPC drum 1. Further, it was observed that the developing bias voltage $V_B$ rises faster than the charged potential $V_D$ of the OPC drum 1 causing a potential difference between the developing bias voltage $V_B$ and the charged potential $V_D$ of the OPC drum 1. This is caused by the difference of response speed between the power pack 3 for the charging roller 2 and the power pack 12 for the developing sleeve 8.

Accordingly, in this embodiment, the charging of the OPC drum 1 is performed increasing the applying voltage in three steps for increasing the charged potential $V_D$ to −390V, −475V, and −880V respectively, and correspondingly, the applying of bias voltage to the developing sleeve 8 is performed increasing the offset voltage in three steps of −625V, −725V, and −1125V such that the mean value per time of the developing bias voltage $V_{DC}$ becomes −100V, −200V, and −600V, respectively. As a result, it was observed that toner does not adhere to the OPC drum 1. This is because a rising up rate per time of the charged potential $V_D$ of the OPC drum 1 is higher than that of the mean value per time of the developing bias voltage $V_{DC}$ in each of the three steps, and thereby, an absolute value of the charged potential $V_D$ of the OPC drum 1 is always greater than that of the mean value per time of the developing bias voltage $V_{DC}$.

Thus, adhesion of toner to a tip portion of a charged area of the OPC drum 1 preceding a latent image portion is avoided by increasing a charging voltage to the OPC drum 1 and increasing a developing bias voltage to the developing sleeve 8 in a plurality of steps.

Furthermore, it was observed in the experiment that, after the charged potential $V_D$ of the OPC drum 1 and the mean value per time of the developing bias voltage $V_{DC}$ have risen to a predetermined level respectively, if an absolute value of the mean value per time of the developing bias voltage $V_{DC}$ is close to or greater than that of the charged potential $V_D$ of the OPC drum 1, adhesion of toner to a background portion of an image and non-image portions of the OPC drum 1 occurs, and if an absolute value of the mean value per time of the developing bias voltage $V_{DC}$ is excessively smaller than that of the charged potential $V_D$ of the OPC drum 1, adhesion of carrier to a background portion of an image and non-image portions of the OPC drum 1 occurs.

FIG. 3 shows a result of an experiment to determine occurrence of adhesion of toner and/or carrier to a background portion of an image and non-image portions of the OPC drum 1. The charged potential $V_D$ of the OPC drum 1 is controlled to be increased in three steps to −390V, −475V, and −880V respectively, and the mean value per time of the developing bias voltage $V_{DC}$ is controlled to be in a range between 50V and −700V.

The result shows that adhering of toner and/or carrier to a background portion of a toner image and non-image portions of the OPC drum 1 can be prevented by selecting a proper mean value per time of the developing bias voltage $V_{DC}$ according to the level of the charged potential $V_D$ of the OPC drum 1.

FIG. 4 is a table showing a range of the mean value per time of the developing bias voltage $V_{DC}$ for each of the levels of the charged potential $V_D$ of the OPC drum 1 in which adhering of toner and/or carrier to a background portion of a toner image and non-image portions of the OPC drum 1 will not occur, which was obtained from the result of this experiment. From this table, it can be said that if a difference between the charged potential $V_D$ of the OPC drum 1 and the mean value per time of the developing bias voltage $V_{DC}$ is within a range between 190V and 375V, adhering of toner and/or carrier to a background portion of a toner image and non-image portions of the OPC drum 1 will not occur. In other words, in order to avoid unnecessary adhering of toner and carrier to the OPC drum 1, the relation between the charged potential $V_D$ of the OPC drum 1 and the mean value per time of the developing bias voltage $V_{DC}$ should hold the following relation:

$$190(\text{V})\leqq(V_{DC}-V_D)\leqq 375(\text{V})$$

Thus, adhering of toner at a tip portion of a charged area of the OPC drum 1 preceding a latent image portion and adhering of toner and/or carrier to a background portion of a toner image and non-image portions of the OPC drum 1 can be avoided by maintaining the above relation between the charged potential $V_D$ of the OPC drum 1 and the mean value per time of the developing bias voltage $V_{DC}$ and by changing the charged potential $V_D$ of the OPC drum 1 and the mean value per time of the developing bias voltage $V_{DC}$ respectively in a plurality of steps so that the absolute value of the mean value per time of the developing bias voltage $V_{DC}$ will not come close to or exceed the absolute value of the charged potential $V_D$ of the OPC drum 1.

Furthermore, a similar result was obtained when the applied oscillating voltage has a peak to peak voltage Vpp in a range of 1 kV to 2 kV, a duty ratio in a range of 50% to 90%, and frequency in a range of 2 KHz to 5 KHz.

Further, a similar result was also obtained when only a DC bias voltage is applied to the developing sleeve 8 (developing bias voltage $V_B$) instead of the oscillating voltage and the value of the DC bias voltage is made the same as that of the mean value per time of the developing bias voltage $V_{DC}$. It was observed that, when charging the OPC drum 1 with the charging roller 2 and applying a bias voltage to the developing sleeve 8 are performed in a plurality of steps, adhering of toner at a tip portion of a charged area of the OPC drum 1 preceding a latent image portion and adhering of toner and/or carrier to a background portion of a toner image and non-image portions of the OPC drum 1 can be avoided by applying only a DC bias voltage as the developing bias voltage $V_B$ holding the relation:

$$190(\mathrm{V}) \leqq (V_B - V_D) \leqq 375(\mathrm{V})$$

and by superimposing an oscillating voltage on the DC bias voltage, when the DC bias voltage reaches a predetermined value for the developing bias voltage, such that the mean value per time of the developing bias voltage $V_{DC}$ equals the predetermined value for the developing bias voltage.

Figure 5:
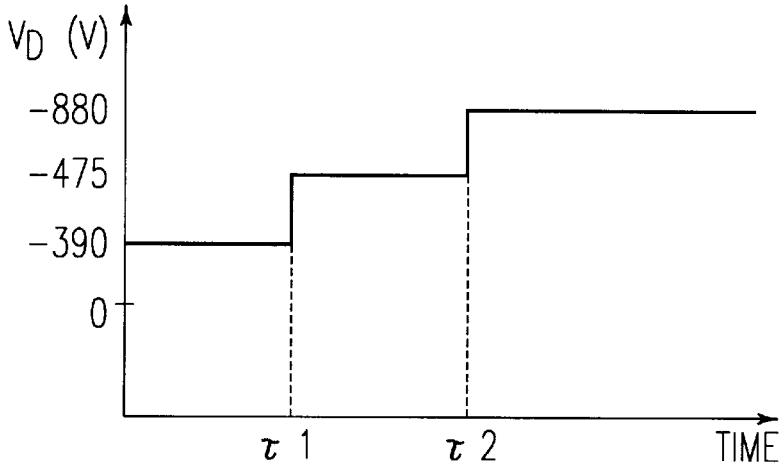
FIG. 5 is a graph showing a charging voltage of an image bearing member charged by a charging device in the first embodiment.
Figure 6:
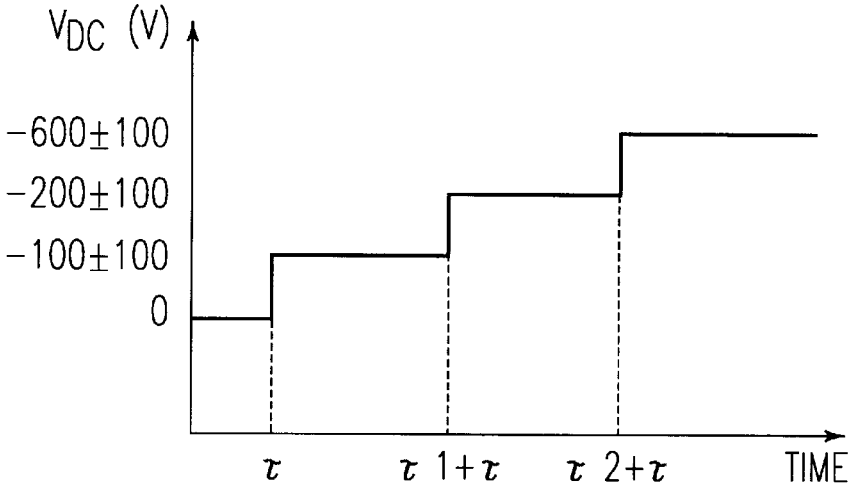
FIG. 6 is a graph showing a bias voltage applied to a developer bearing member in the first embodiment.

Accordingly, in this embodiment, as illustrated in FIG. 5, a control device 13 controls the power pack 3 to control the charging voltage applied to the OPC drum 1 by the charging roller 2 such that the OPC drum 1 is charged to −390V during a period from a starting time of applying the charging voltage by the charging roller 2 to a time $\tau 1$, to −475V in a period from the time $\tau 1$ to a time $\tau 2$, and to −880V after the time $\tau 2$.

The control device 13 also controls the power pack 12 to control the applying voltage to the developing sleeve 8 such that the mean value per time of the developing bias voltage $V_{DC}$ to the developing sleeve 8 is 0V in a period from a starting time of applying a developing bias voltage to the developing sleeve 8 to a time $\tau$, to −100±100V in a period from the time $\tau$ to a time $\tau 1+\tau$, to −200±100V in a period from the time $\tau 1+\tau$ to a time $\tau 2+\tau$, and to −600±100V after the time $\tau 2+\tau$. In the above description, the time $\tau$ represents a time during which the OPC drum 1 is charged with the charging roller 2 and the charged area of the OPC drum 1 moves to the developing device 6 (the developing area), the time $\tau 1$ represents a time during which the OPC drum 1 keeps the charged potential of −390V, and the time $\tau 2$ represents a time during which the OPC drum 1 keeps the charged potential of −475V. The value of the charged potential $V_D$ of the OPC drum 1 is not limited to the above-described −390V, −475V, and −880V, and other values can be used. Further, the time of $\tau 1$ and $\tau 2$ can be changed depending on the response speed of the power pack for the developer bearing member.

Figure 7:
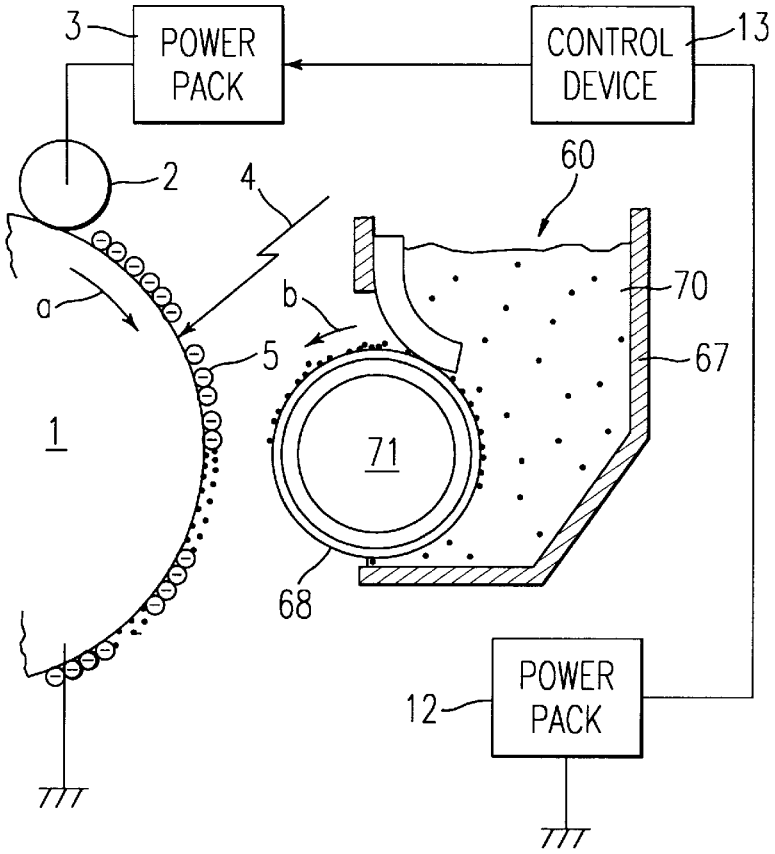
FIG. 7 is a sectional view of a part of a second exemplary embodiment of the present invention.
Figure 8:
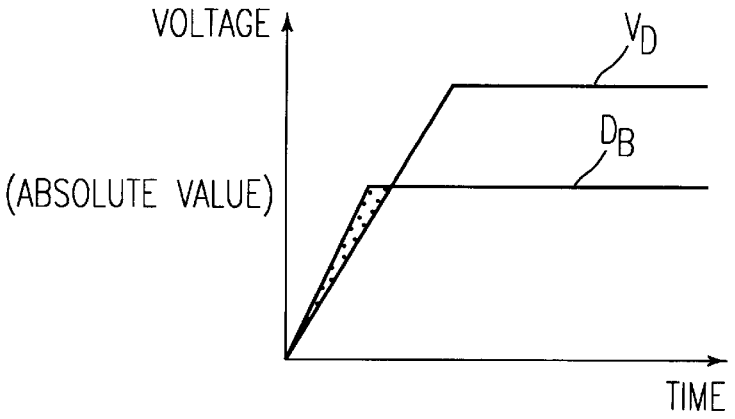
FIG. 8 is a graph showing a charging voltage of an image bearing member and a bias voltage applied to a developer bearing member in a background image forming apparatus.

The present invention is also applicable to an image forming apparatus including a one-component developing device illustrated in FIG. 7. A one-component developing device 60 includes a developer container 67 which contains one-component developer 70 composed of magnetic toner, and a developing sleeve 68 which is disposed in the developer container 67 so as to be rotatably supported by the developer container 67. The developing sleeve 68 is rotated in a counterclockwise direction indicated by an arrow b in a developing operation. The magnetic toner is charged, for example, to a negative polarity by friction between the particles of the magnetic toner. A magnet 71 is disposed inside the developing sleeve 68. Rotation of the developing sleeve 68 causes the one-component developer 70 to be carried on a circumferential surface of the developing sleeve 68 by a magnetic force and to be moved in the rotational direction to a developing area between the developing sleeve 68 and the OPC drum 1. The latent image 5 on the OPC drum 1 is developed with the one-component developer 70 on the developing sleeve 68 in the developing area to become a toner image. The construction and operation of other parts of the image forming apparatus using the one-component developing device 60 are substantially the same as those of the image forming apparatus using the two-component developing device 6 in the aforementioned embodiment.

A developing bias voltage is applied to the developing sleeve 68 from a power pack 12 in substantially the same manner as described in the aforementioned embodiment using a two-component developing device, and thereby adhering of toner at a tip portion of a charged area of the OPC drum 1 preceding a latent image portion and adhering of toner to a background portion of a toner image and non-image portions of the OPC drum 1 are prevented.

In this one-component developing device 60, when an absolute value of a charged potential $V_D$ of the OPC drum 1 is excessively smaller than an absolute value of a developing bias voltage $V_B$, adhering of oppositely charged toner to a background portion of a toner image and non-image portions of the OPC drum 1 occurs. These problems are also resolved by applying a developing bias voltage to the developing sleeve 68 in a substantially same manner as described in the aforementioned embodiment using a two-component developing device.

Further, the present invention is also applicable to an image forming apparatus using a one-component developing device including a non-magnetic toner. Furthermore, the present invention is applicable to an image forming apparatus using a charging device other than a charging roller and using a transfer device other than a transfer roller.

This application is based on Japanese Patent Application No. 09-270769 filed in the Japanese Patent Office on Oct. 3, 1997, and No. 10-243867 filed on Aug. 28, 1998 respectively, the entire contents of which are hereby incorporated by reference.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus comprising:

a charging element configured to apply a charging voltage to an image bearing member to charge the image bearing member;

an optical writing device configured to form a latent image on a charged surface of the image bearing member charged by the charging element;

a developer bearing member which carries developer including toner having a same polarity as that of the charging voltage to the image bearing member and which applies the toner to the latent image on the image bearing member to form a toner image when a developing bias voltage is applied thereto; and a control device which controls application of said charging voltage by said charging element and application of said developing bias voltage to said developer bearing member so as to increase an absolute value of the charging voltage to the image bearing member and an absolute value of the developing bias voltage to the developer bearing member to a predetermined value in a plurality of steps, respectively;

wherein the control device controls the developing bias voltage applied to the developer bearing member to be an oscillating voltage having a plurality of potentials, and wherein the following relation holds in each of the plurality of steps:

$$190(V) \leqq (V_{DC} - V_D) \leqq 375(V),$$

where $V_{DC}$ represents a mean value per time of developing bias voltage applied to the developer bearing member and $V_D$ represents a charged potential of the image bearing member.

2. The image forming apparatus according to claim 1, wherein the control device controls the developing bias voltage applied to the developer bearing member to be an oscillating voltage having a rectangular waveform.

3. The image forming apparatus according to claim 1, wherein the developer includes a mixture of carrier and toner.

4. The image forming apparatus according to claim 1 further comprising:

a contact transferring device which contacts the image bearing member and transfers the toner image on the image bearing member to a transfer medium.

5. An image forming apparatus comprising:

a charging element configured to apply a charging voltage to an image bearing member to charge the image bearing member;

an optical writing device configured to form a latent image on a charged surface of the image bearing member charged by the charging element;

a developer bearing member which carries developer including toner having a same polarity as that of the charging voltage to the image bearing member and which applies the toner to the latent image on the image bearing member to form a toner image when a developing bias voltage is applied thereto; and a control device which controls application of said charging voltage by said charging element and application of said developing bias voltage to said developer bearing member so as to increase an absolute value of the charging voltage to the image bearing member and an absolute value of the developing bias voltage to the developer bearing member to a predetermined value in a plurality of steps, respectively;

wherein the control device is configured to increase a DC bias voltage applied to the developer bearing member to a predetermined value in said plurality of steps and then to control application of an oscillating voltage superimposed on the DC bias voltage as the developing voltage to the developer bearing member, wherein the following relation holds in each of the plurality of steps:

$$190(V) \leqq (V_B - V_D) \leqq 375(V),$$

where $V_B$ represents a developing bias voltage applied to the developer bearing member and $V_D$ represents a charged potential of the image bearing member.

6. The apparatus according to claim 5, wherein after the predetermined value of $V_B$ is reached and the oscillating voltage is superimposed on the DC bias voltage as the developing voltage, the control device is configured to hold the following relationship:

$$190(V) \leqq (V_{DC} - V_D) \leqq 375(V),$$

where $V_{DC}$ represents a mean value per time of developing bias voltage applied to the developer bearing.

7. A method of forming an image, comprising steps of:

applying a charging voltage to an image bearing member;

forming a latent image on a charged surface of the image bearing member;

applying toner carried by a developer bearing member and having a same polarity as that of the charging of the image bearing member to the latent image on the image bearing member to form a toner image when a developing bias is applied to the developer bearing member; and increasing an absolute value of the charging voltage to the image bearing member and an absolute value of the developing bias voltage to the developer bearing member in a plurality of steps, respectively, including controlling the developing bias voltage applied to the developer bearing member to be an oscillating voltage having a plurality of potentials, and controlling each of the plurality of steps of increasing the absolute value of the charging voltage to the image bearing member and the absolute value of the developing bias voltage to the developer bearing member so that the following relationship holds, $$190(V) \leqq (V_{DC} - V_D) \leqq 375(V),$$

where $V_{DC}$ represents a mean value per time of developing bias voltage applied to the developer bearing member and $V_D$ represents a charged potential of the image bearing member.

8. An image forming apparatus comprising:

means for applying a charging voltage to an image bearing member to charge the image bearing member;

an optical writing means for forming a latent image on a charged surface of the image bearing member charged by the means for applying;

means for carrying developer including toner having a same polarity as that of the charging voltage to the image bearing member and applying the toner to the latent image on the image bearing member to form a toner image when a developing bias voltage is applied to the means for carrying developer; and means for controlling to increase in an absolute value of the charging voltage to the image bearing member and an absolute value of the developing bias voltage to the developer bearing means to a predetermined value in a plurality of steps, respectively, including means for controlling the developing bias voltage applied to the developer bearing member to be an oscillating voltage having a plurality of potentials, and means for controlling each of the plurality of steps of increasing the absolute value of the charging voltage to the image bearing member and the absolute value of the developing bias voltage to the developer bearing member so that the following relationship holds, $$190(V) \leqq (V_{DC}-V_D) \leqq 375(V),$$

where $V_{DC}$ represents a mean value per time of developing bias voltage applied to the developer bearing member and $V_D$ represents a charged potential of the image bearing member.

9. A method of forming an image, comprising steps of:

applying a charging voltage to an image bearing member;

forming a latent image on a charged surface of the image bearing member;

applying toner carried by a developer bearing member and having a same polarity as that of the charging of the image bearing member to the latent image on the image bearing member to form a toner image when a developing bias is applied to the developer bearing member; and increasing an absolute value of the charging voltage to the image bearing member and an absolute value of the developing bias voltage to the developer bearing member in a plurality of steps, respectively, including increasing a DC bias voltage applied to the developer bearing member to a predetermined value in said plurality of steps and then to applying an oscillating voltage superimposed on the DC bias voltage as the developing voltage to the developer bearing member, wherein the following relation holds in each of the plurality of steps of increasing a DC bias voltage applied to the developer bearing member to a predetermined value:

$$190(V) \leqq (V_B-V_D) \leqq 375(V),$$

where $V_B$ represents a developing bias voltage applied to the developer bearing member and $V_D$ represents a charged potential of the image bearing member.

10. The method according to claim 9, wherein after the predetermined value of $V_B$ is reached and the oscillating voltage is superimposed on the DC bias voltage as the developing voltage, the following relationship is held:

$$190(V) \leqq (V_{DC}-V_D) \leqq 375(V),$$

where $V_{DC}$ represents a mean value per time of developing bias voltage applied to the developer bearing.

11. An image forming apparatus comprising:

means for applying a charging voltage to an image bearing member to charge the image bearing member;

an optical writing means for forming a latent image on a charged surface of the image bearing member charged by the means for applying;

means for carrying developer including toner having a same polarity as that of the charging voltage to the image bearing member and applying the toner to the latent image on the image bearing member to form a toner image when a developing bias voltage is applied to the means for carrying developer; and means for controlling to increase an absolute value of the charging voltage to the image bearing member and an absolute value of the developing bias voltage to the developer bearing means to a predetermined value in a plurality of steps, respectively, including means for increasing a DC bias voltage applied to the developer bearing member to a predetermined value in said plurality of steps and then to control application of an oscillating voltage superimposed on the DC bias voltage as the developing voltage to the developer bearing member, including means for holding the following relation in each of the plurality of steps increasing a DC bias voltage applied to the developer bearing member to a predetermined value:

$$190(V) \leqq (V_B-V_D) \leqq 375(V),$$

where $V_B$ represents a developing bias voltage applied to the developer bearing member and $V_D$ represents a charged potential of the image bearing member.

12. The apparatus according to claim 11, wherein the means for increasing includes, after the predetermined value of $V_B$ is reached and the oscillating voltage is superimposed on the DC bias voltage as the developing voltage, means for holding the following relationship:

$$190(V) \leqq (V_{DC}-V_D) \leqq 375(V),$$

where $V_{DC}$ represents a mean value per time of developing bias voltage applied to the developer bearing.

* * * * *